United States Patent [19]

Dellinger

[11] Patent Number: 4,643,264

[45] Date of Patent: Feb. 17, 1987

[54] METHOD FOR REDUCING DRILLING TORQUE IN THE DRILLING OF A DEVIATED WELLBORE

[75] Inventor: Thomas B. Dellinger, Duncanville, Tex.

[73] Assignee: Mobil Oil Corporation, New York, N.Y.

[21] Appl. No.: 668,920

[22] Filed: Nov. 6, 1984

[51] Int. Cl.[4] ..... F21B 7/04

[52] U.S. Cl. ..... 175/61; 175/65; 175/73

[58] Field of Search ..... 175/61, 62, 65, 73, 175/75, 91, 101, 107, 38, 45

[56] References Cited

U.S. PATENT DOCUMENTS 3,260,318 7/1966 Neilson et al. ..... 175/107 X 3,637,032 1/1972 Jeter ..... 175/73

3,841,420 10/1974 Russell ..... 175/73 X 4,492,276 1/1985 Kamp ..... 175/75 X

*Primary Examiner*—Stephen J. Novosad

*Assistant Examiner*—David J. Bagnell

*Attorney, Agent, or Firm*—Alexander J. McKillop; Michael G. Gilman; George W. Hager, Jr.

[57] ABSTRACT

A rotary well drilling system employs a drill pipe with a drill bit affixed at its lower end for the drilling of a deviated wellbore. Drilling fluid is circulated through the drill pipe to remove drill cuttings. The drill bit is rotated in the opposite direction from that of the drill pipe to reduce the torque required to rotate the drill pipe as it is rotationally dragged along the lower side of the wellbore walls during the drilling of the deviated wellbore.

3 Claims, 1 Drawing Figure

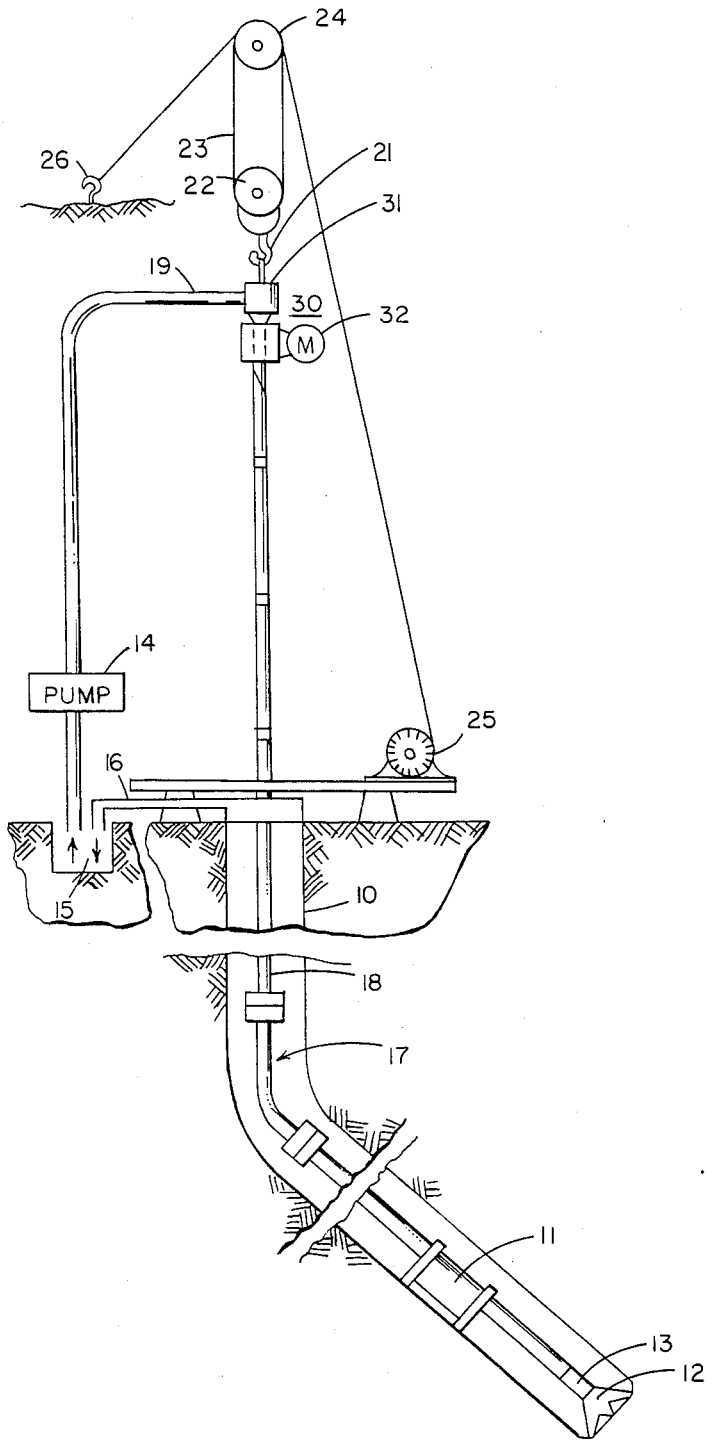
24
23
26
22
21
31
19
30
32
M
14
PUMP
25
16
15
10
18
17
11
13
12

METHOD FOR REDUCING DRILLING TORQUE IN THE DRILLING OF A DEVIATED WELLBORE

BACKGROUND OF THE INVENTION

Drilling of oil wells has progressed from crude drilling rigs, to cable tool rigs, to the modern rotary drilling rigs. In rotary conventional drilling, a power rotating means delivers torque to a drill string comprising sections of drill pipe which turns a bit drilling a borehole into the subsurface formations. The drill string is raised and lowered in the borehole from support means affixed to a conventional drilling rig. Suspended over pulleys positioned at the upper end or top of the rig are a plurality of cables which support a traveling block. Suspended from the traveling block is a swivel. The swivel is secured to a kelly which supports the drill string. The kelly is square or hexagonal in cross-section over a substantial portion of its length and fits in sliding relation through a rotary table in the rig floor. The rotary table, driven by a suitable prime mover, serves to turn the kelly, thereby rotating the drill string. Due to the sliding fit between the kelly and the rotary table, the kelly slides downwardly through the rotary table as drilling progresses. While the power for rotating the kelly, and thus the drill string, is applied to the rotary table, the entire weight of the kelly and drill string is supported by the swivel which also functions to conduct drilling fluid to the kelly and drill string. Drilling fluid, generally from a mud tank or mud pit, passes through a hose into the swivel, downward through the sections of drill pipe, and out through openings in the drill bit into the borehole. The drilling fluid then circulates upward from the drill bit, carrying formation cuttings through the annulus between the sections of drill pipe and the borehole wall to the surface of the earth where it returns to the mud tank or pit. When it is necessary to add another section of drill pipe during drilling to the wellbore or to remove a section of drill pipe when pulling out of the borehole (i.e., tripping), the traveling block, swivel, and kelly are lowered or raised as needed by manipulation of the cables. Such a conventional drilling system is illustrated in U.S. Pat. Nos. 3,235,014; 3,324,717; 3,417,830; and 4,114,435.

Recent developments in drilling technology have replaced the conventional kelly and rotary table drive system with a power swivel employing an electric drive system for directly rotating the drill string. The power swivel is suspended from the traveling block and is fully compatible with the derricks or masts of the conventional drilling rig as well as the hoisting and electrical power systems of such rigs. One of the several advantages of the power-swivel top drive drilling system over the kelly and rotary table drilling system is the ability to rotate the drill string and circulate the drilling fluid when raising or lowering (i.e., tripping) of the drill pipe in or out of the borehole. This ability to rotate and circulate at any time while tripping provides significant time savings and safety features, especially where the potential for preventing sticking of drill pipe in tight sections or high angle boreholes is greatly increased.

SUMMARY OF THE INVENTION

In accordance with the present invention, there is provided a method for reducing the torque required to rotate the drill string in the drilling of a deviated wellbore in which the drill string lies along the lower side of the wall of the deviated wellbore.

More particularly, the drill string is comprised of a plurality of sections of drill pipe with a drill bit at the lower end thereof. The drill pipe is rotated against the friction provided by the lower side of the wellbore as the drill pipe drags along such lower side of the wellbore during the drilling of the deviated wellbore. The drill bit is rotated independently of the rotation of the drill pipe such that the torque required for the rotation of the drill bit subtracts from the torque otherwise required for the rotation of the drill pipe.

To effect such subtraction, the drill bit is rotated in the opposite direction from the rotation of the drill pipe. Such drill bit rotation is carried out by a positive displacement downhole motor that is powered by means of the circulating drilling fluid.

BRIEF DESCRIPTION OF THE DRAWING

The sole FIGURE illustrates a well drilling system for drilling a deviated well and in which the method of the present invention may be used.

DESCRIPTION OF THE PREFERRED EMBODIMENT

Referring now to the FIGURE, there is shown a deviated well 10 being drilled into the earth by rotary drilling and in which the method of the present invention may be utilized. A drill string 17 is suspended within the well 10, and includes a drill pipe 18, a plurality of drill collars 11 and a drill bit 12. A top drive drill system 30, including a swivel 31 and driving motor 32, rotates the drill string 17. Generally, the drill string 17 is held in tension and only the weight of the drill collars 11 or less is allowed on the drill bit 12. Hence, a major portion of the load is borne by the hook 21 attached to the traveling block 22. The traveling block is moved by multiple windings of cable 23 between it and a crown block 24. One end of the cable 23, the so-called "dead line," is held by a dead line anchor 26. The other end of the cable 23 is fastened to the drum 25 of the drawworks and is wound onto it by rotation of that drum. To achieve less or more weight on the drill bit 12, the traveling block 22 is raised or lowered to take more or less of the weight of the drill collars 11. Simultaneously with the rotation of the drill string 17, a drilling fluid from a mud tank or pit 15 is circulated by a drilling fluid pump 14 through the line 19 into the swivel 31 and hence, into the drill string 17. The drilling fluid flows down through the drill string 17 and out through openings in the drill bit 12 into the well 10. The drilling fluid then circulates upward from the drill bit 12, carrying formation cuttings through the annulus between the drill string 17 and the well 10 to the surface of the earth. A line 16 returns the drilling fluid from the well 10 to the pit 15.

However, in deviated wellbores of high angles of inclination over about 60°, the drill string will not slide into the wellbore under its own weight. At inclinations above about 80° and with frictional coefficients greater than 0.2, the entire weight of the drill string rests against the lower side of the wellbore wall. Such high angles of inclination significantly increase the torque required for rotation of the drill string. For example, as great as 15,000 ft.-lbs. may be required for rotating the drill pipe while an additional 2,000 ft.-lbs. may be required for rotation of the drill bit. These two torques would normally be additive, thereby requiring 17,000 ft.-lbs. to rotate the entire drill string. It is, therefore, the specific feature of the present invention to provide a method for reducing such torque requirement in the drilling of a high-angle wellbore.

This method is carried out by providing a downhole drill bit motor 13 that is free to rotate the drill bit 12 independently of the rotation of the drill pipe 18 by the top drive drill motor 32. During drilling, when the drill pipe is being rotated in one direction and drilling fluid is being circulated, the downhole drill motor rotates the drill bit in the opposite direction from that of the drill pipe. In this manner, the torque required for rotation of the drill bit subtracts, rather than adds, from the torque required for the rotation of the drill pipe. Thus, instead of the example of 17,000 ft.-lbs. of required torque, a torque of only 13,000 ft.-lbs. (i.e., 15,000 ft.-lbs. minus 2,000 ft.-lbs.) is required, thereby effecting a significant torque requirement reduction.

In one embodiment, the top drive drilling motor, or power swivel system, for use in rotation of the drill pipe is of the type manufactured and supplied by Varco Drilling Systems, a Varco International, Inc. company, 800 N. Eckhoff Street, Orange, Calif. 92668. Such system is illustrated and described in conjunction with well drilling operations in an article entitled "New Power System Looks Promising," *Drilling Contractor,* March 1983, an official publication of the International Association of Drilling Contractors. The downhole drill motor for use in rotation of the drill bit is preferably a positive-displacement-type that is driven by power supplied from the circulating drilling fluid, such as the Moineau pump manufactured and supplied by Dyna-Drill, Irvine, California. The rotational speed of the positive-displacement downhole motor is determined by the flow rate of the circulating drilling fluid. Thus, with a drill pipe 18 rotational speed about 40 to 100 rpm during drilling of a deviated wellbore with inclination of at least 60°, the drilling fluid circulation is adjusted by means of pump 14 to provide an opposite rotational speed of about 300 to 350 rpm for the downhole motor 13 and drill bit 12. A turbine-type downhole motor could alternatively be utilized, but its speed is not controllable as is the positive-displacement-type motor.

Having now described the method of the present invention in connection with a preferred embodiment, it is to be understood that various modifications and changes may be made without departing from the spirit and scope of the invention as set forth in the appended claims.

I claim:

1. A method for the rotary drilling of a deviated wellbore with a drill string formed with a plurality of sections of drill pipe and a drill bit at the lower end thereof lying along the lower side of the deviated wellbore, comprising the steps of:

(a) rotating the drill pipe against the friction provided by the lower side of the wellbore as said drill pipe drags along the lower side of the wall of said wellbore during the drilling of a deviated wellbore that is inclined to such an extent that the entire weight of said drill string rests on the lower side of the wall of said wellbore and the drill string does not slide along the wellbore under its own weight, and (b) rotating the drill bit oppositely of the rotation of said drill pipe such that the torque utilized for rotating said drill bit subtracts from the torque otherwise required for the rotation of said drill pipe.

2. The method of claim 1 wherein the opposite rotational speeds of said drill pipe and said drill bit are in the range of 40 to 60 revolutions per minute for said drill pipe and 300 and 350 revolutions per minute for said drill bit.

3. The method of claim 1 wherein said deviated wellbore is drilled at an inclination of at least 80° and the frictional coefficient for the sliding of said drill string down the wellbore is at least 0.2.

* * * * *